US008684279B1

(12) United States Patent
Bledsoe

(10) Patent No.: US 8,684,279 B1
(45) Date of Patent: Apr. 1, 2014

(54) RAILROAD ALIGNMENT SYSTEM

(76) Inventor: Jessie L. Bledsoe, West Fargo, ND (US)

( * ) Notice: Subject to any disclaimer, the term of this patent is extended or adjusted under 35 U.S.C. 154(b) by 182 days.

(21) Appl. No.: 13/272,403

(22) Filed: Oct. 13, 2011

(51) Int. Cl.
*E01B 11/00* (2006.01)
*E01B 9/00* (2006.01)
*E01B 29/05* (2006.01)

(52) U.S. Cl.
USPC ..... 238/168; 238/336; 104/2

(58) Field of Classification Search
USPC ..... 104/2, 7.1, 8, 15; 238/151, 168, 169, 238/310, 312, 336, 338
See application file for complete search history.

(56) References Cited

U.S. PATENT DOCUMENTS 4,320,708 A 3/1982 Bommart
4,497,255 A 2/1985 Theurer
4,565,133 A 1/1986 Moore
4,641,818 A 2/1987 Bommart
4,753,424 A 6/1988 Sato
5,575,416 A 11/1996 Oellerer
6,385,861 B1 5/2002 Blackwell
6,651,353 B1 11/2003 Evans
6,787,726 B2 * 9/2004 Thelen et al. ..... 219/54

* cited by examiner

*Primary Examiner* — R. J. McCarry, Jr.
(74) *Attorney, Agent, or Firm* — Jason L. Gilbert

(57) ABSTRACT

A railroad alignment system for easily and efficiently lifting and aligning railroad tracks during installation. The railroad alignment system generally includes first vertical support and a second vertical support with a horizontal support extending therebetween. The vertical supports are vertically adjustable through use of a pair of adjustment members. A clamp assembly extends downwardly from the horizontal support at a position midway between the first vertical support and second vertical support. Through use of a pair of adjustment members, the clamp assembly may be closed to secure a track in place for alignment and lifting.

2 Claims, 6 Drawing Sheets

RAILROAD ALIGNMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an alignment system for railroad tracks and more specifically it relates to a railroad alignment system for easily and efficiently lifting and aligning railroad tracks during installation.

2. Description of the Related Art

Any discussion of the related art throughout the specification should in no way be considered as an admission that such related art is widely known or forms part of common general knowledge in the field.

Proper alignment is extremely important for safely and effectively installing, repairing or replacing railroad tracks. Failure to properly align the tracks can result in an increased risk of danger to passengers and operators of any trains passing thereon. Further, the significant weight or most railroad tracks can increase the difficulty of lifting the track and ensuring proper alignment.

While a number of devices and systems exist for the alignment of railroad tracks, previously existing systems have generally been limited in their lifting capacity and tend to be difficult to maneuver. Additionally, existing systems for railroad alignment tend to be difficult to operate, which can significantly delay the completion of track alignment, replacement and repair projects.

Because of the inherent problems with the related art, there is a need for a new and improved railroad alignment system for easily and efficiently lifting and aligning railroad tracks during installation.

BRIEF SUMMARY OF THE INVENTION

The invention generally relates to a railroad alignment system which includes a first vertical support and a second vertical support with a horizontal support extending therebetween. The vertical supports are vertically adjustable through use of a pair of adjustment members. A clamp assembly extends downwardly from the horizontal support at a position midway between the first vertical support and second vertical support. Through use of a pair of adjustment members, the clamp assembly may be closed to secure a track in place for alignment and lifting.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
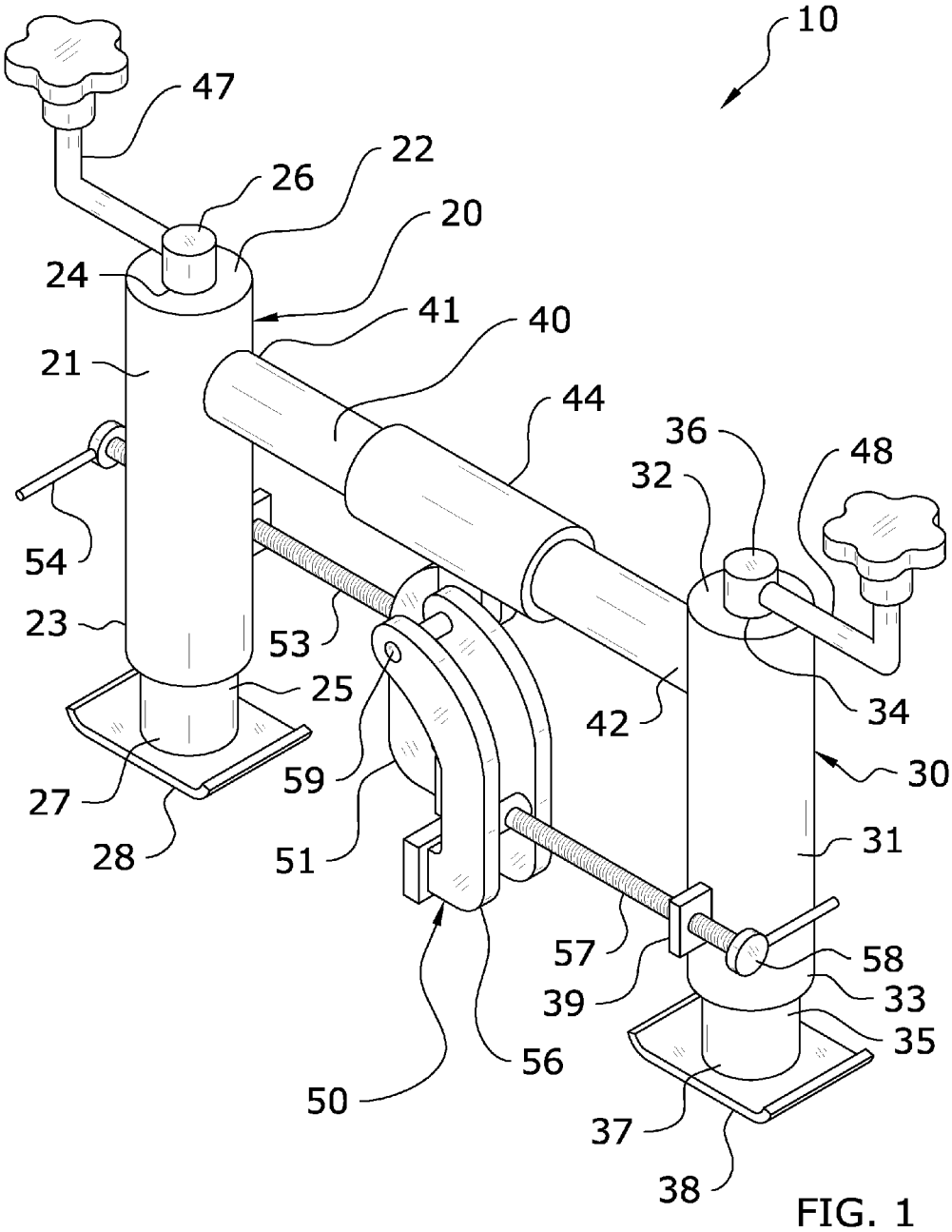
FIG. 1 is an upper perspective view of the present invention.

Turning now descriptively to the drawings, in which similar reference characters denote similar elements throughout the several views, FIGS. 1 through 6 illustrate a railroad alignment system 10, which comprises a first vertical support 20 and a second vertical support 30 with a horizontal support 40 extending therebetween. The vertical supports 20, 30 are vertically adjustable through use of a pair of adjustment members 47, 48. A clamp assembly 50 extends downwardly from the horizontal support 40 at a position midway between the first vertical support 20 and second vertical support 30. Through use of a pair of adjustment members 54, 58, the clamp assembly 50 may be closed to secure a track 12 in place for alignment and lifting.

B. Vertical Supports

The present invention will generally include a pair of vertical supports 20, 30 as shown in FIG. 1. The vertical supports 20, 30 of the present invention act as the legs of the invention while in use. The vertical supports 20, 30 are also preferably vertical adjustable to assist in lifting railroad tracks 12 during installation. Accordingly, the vertical supports 20, 30 will generally be durable and able to accommodate at least 4000 pounds without warping, breaking or otherwise becoming damaged.

Figure 2:
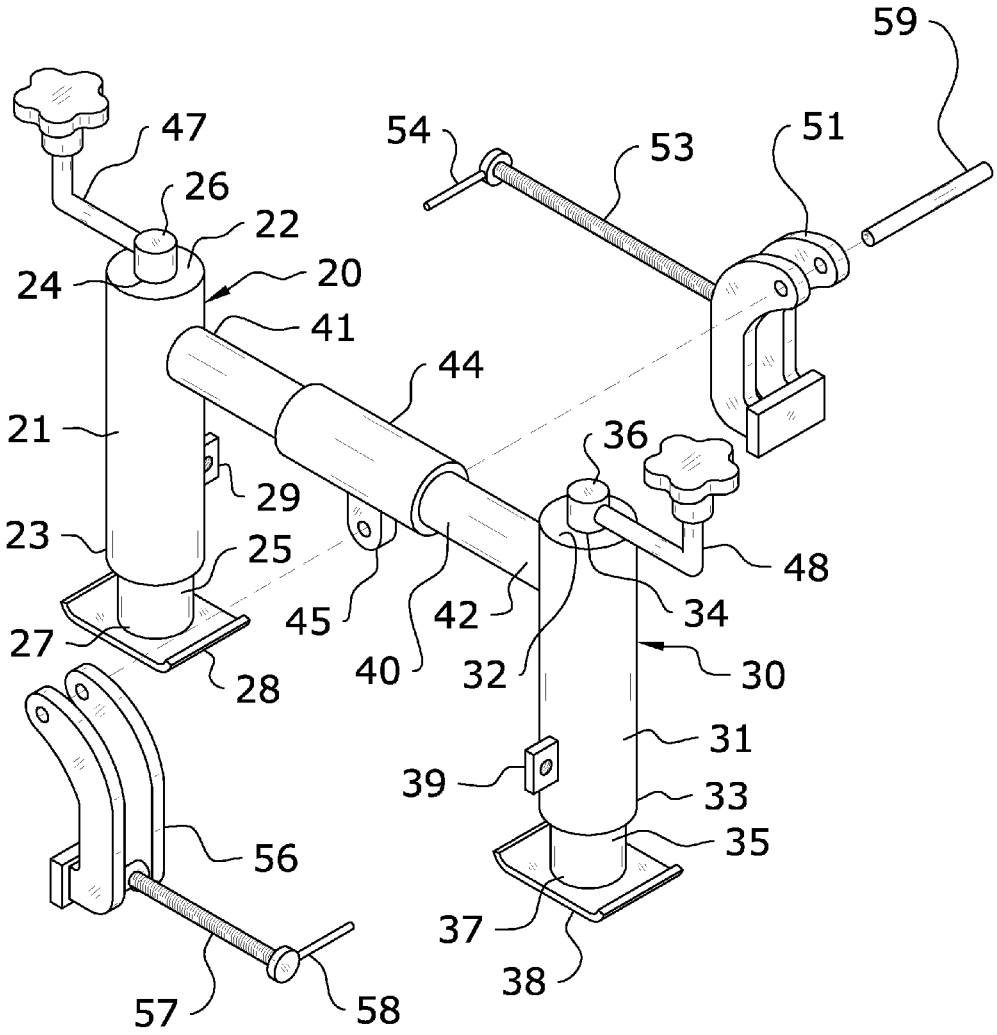
FIG. 2 is an upper perspective view of the present invention with the clamp assembly disassembled.

The first vertical support 20 will generally be positioned on a first side of the track 12 for installation and alignment. As shown in FIG. 2, the first vertical support 20 of the present invention will generally include a substantially hollow outer member 21 and an inner member 25 slidably positioned within the outer member 21.

The outer member 21 of the first vertical support 20 will preferably be comprised of a cylindrical configuration as shown in the figures, though it is appreciated that various other shapes and configurations may be utilized. The outer member 21 will generally include an upper end 22 and a lower end 23. An opening 24 will generally be positioned at the upper end 22 of the outer member 21. The upper end 26 of the inner member 25 will generally extend upwardly through the upper opening 24 of the outer member 21 as shown in FIG. 1.

The lower end 27 of the inner member 25 will also generally extend downwardly from the lower end 23 of the outer member 21.

The outer member 21 of the first vertical support 20 will also generally include a bracket 29, which is utilized to secure the clamp assembly 50 of the present invention thereto. The bracket 29 may be positioned at various locations on the outer surface of the outer member 21, though it will preferably be positioned approximately halfway up the body of the outer member 21.

The inner member 25 of the first vertical support 20 will preferably be comprised of a substantially cylindrical configuration as shown in the figures, though it is appreciated that various other shapes and configurations may be utilized. The inner member 25 will generally be slidably positioned within the outer member 21 in a manner which allows the first vertical support 20 to be vertically adjustable when in use.

The inner member 25 of the first vertical support 20 will generally include an upper end 26 and a lower end 27. The upper end 26 of the inner member 25 will generally be comprised of an extension having a smaller diameter than that of the rest of the length of the inner member 25. The upper end 26 will preferably extend upwardly through the opening 24 of the outer member 21. A first adjustment member 47 will generally be fixedly attached to the upper end 26 of the inner member 25, wherein rotation of the first adjustment member 47 in a first direction will cause the first vertical support 20 to extend vertically and rotation of the first adjustment member 47 in a second direction will cause the first vertical support 20 retract vertically.

Figure 3:
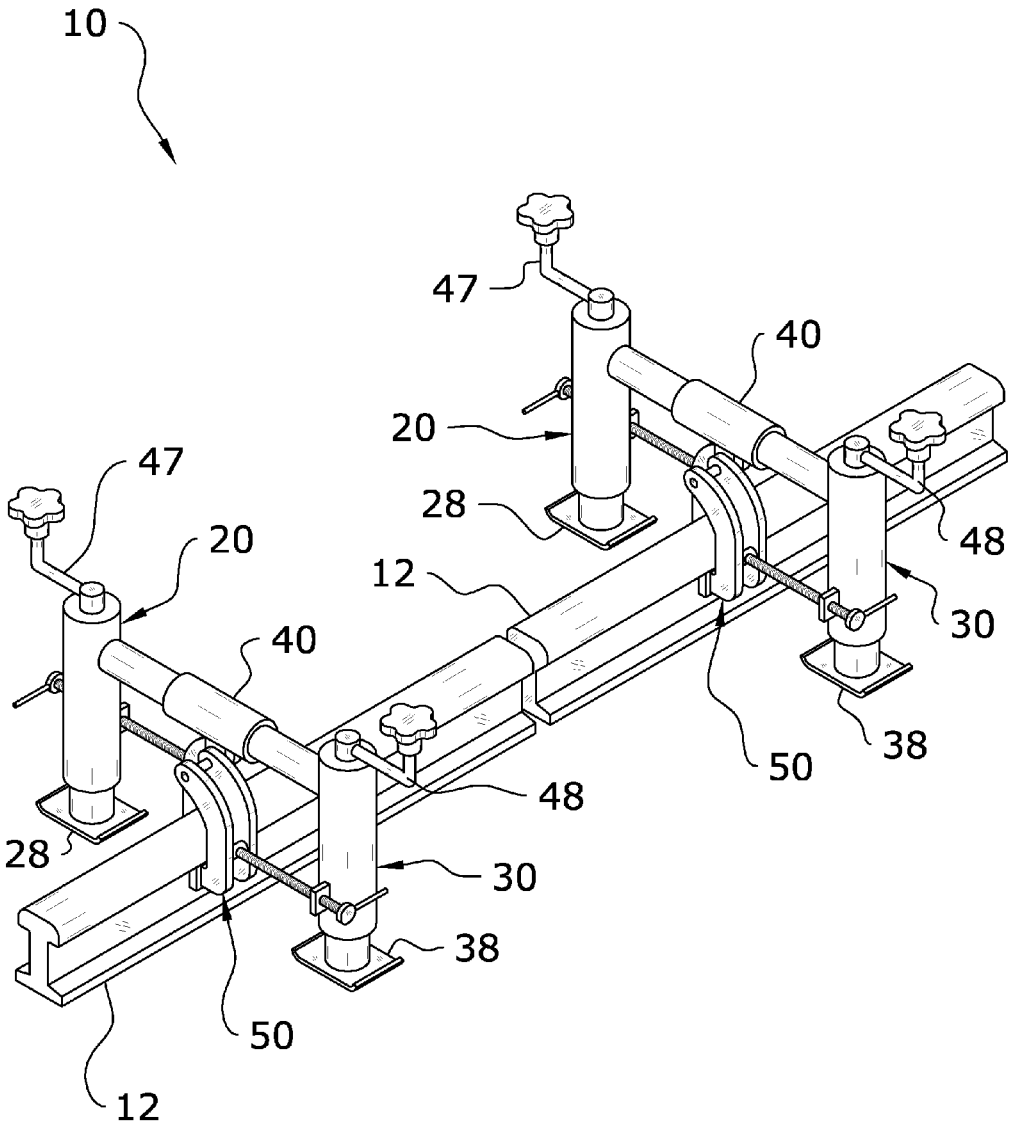
FIG. 3 is an upper perspective view of the present invention in use.

The lower end 27 of the inner member 25 of the first vertical support 20 will generally include a foot member 28. The foot member 28 will preferably be comprised of a substantially flat, rectangular member which rests on the ground adjacent the track 12 when the present invention is in use as shown in FIG. 3. It is appreciated that various shapes and configurations may be utilized for the foot member 28 and its structure should not be construed as being limited to that which is shown in the figures.

The second vertical support 30 will generally be positioned on a second side of the track 12 for installation and alignment. As shown in FIG. 2, the second vertical support 30 of the present invention will generally include a substantially hollow outer member 31 and an inner member 35 slidably positioned within the outer member 31.

The outer member 31 of the second vertical support 30 will preferably be comprised of a cylindrical configuration as shown in the figures, though it is appreciated that various other shapes and configurations may be utilized. The outer member 31 will generally include an upper end 32 and a lower end 33. An opening 34 will generally be positioned at the upper end 32 of the outer member 31. The upper end 36 of the inner member 35 will generally extend upwardly through the upper opening 34 of the outer member 31 as shown in FIG. 1. The lower end 37 of the inner member 35 will also generally extend downwardly from the lower end 33 of the outer member 31.

The outer member 31 of the second vertical support 30 will also generally include a bracket 39, which is utilized to secure the clamp assembly 50 of the present invention thereto. The bracket 39 may be positioned at various locations on the outer surface of the outer member 31, though it will preferably be positioned approximately halfway up the body of the outer member 31.

The inner member 35 of the second vertical support 30 will preferably be comprised of a substantially cylindrical configuration as shown in the figures, though it is appreciated that various other shapes and configurations may be utilized. The inner member 35 will generally be slidably positioned within the outer member 31 in a manner which allows the second vertical support 30 to be vertically adjustable when in use.

Figure 6:
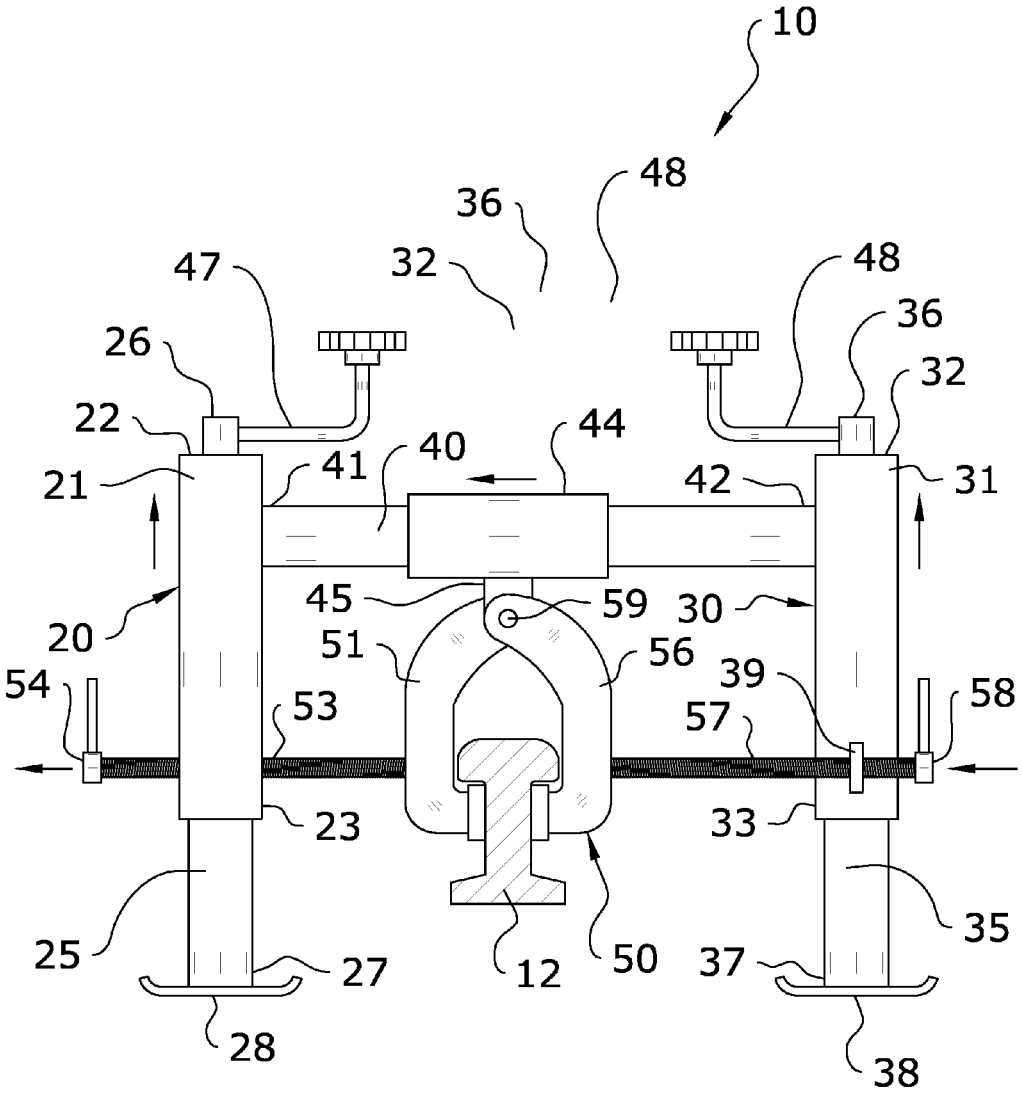
FIG. 6 is a third front view of the present invention in use.

The inner member 35 of the second vertical support 30 will generally include an upper end 36 and a lower end 37. The upper end 36 of the inner member 35 will generally be comprised of an extension having a smaller diameter than that of the rest of the length of the inner member 35. The upper end 36 will preferably extend upwardly through the opening 34 of the outer member 31. A second adjustment member 48 will generally be fixedly attached to the upper end 36 of the inner member 35, wherein rotation of the first adjustment member 47 in a first direction will cause the second vertical support 30 to extend vertically and rotation of the second adjustment member 48 in a second direction will cause the second vertical support 30 retract vertically as shown in FIG. 6.

The lower end 37 of the inner member 35 of the second vertical support 30 will generally include a foot member 38. The foot member 38 will preferably be comprised of a substantially flat, rectangular member which rests on the ground adjacent the track 12 when the present invention is in use as shown in FIG. 3. It is appreciated that various shapes and configurations may be utilized for the foot member 38 and its structure should not be construed as being limited to that which is shown in the figures.

C. Horizontal Support

The present invention will generally include a horizontal support 40 which extends between the first vertical support 20 and second vertical support 30 as shown in FIG. 1. The horizontal support 40 will generally include a first end 41 and a second end 42, wherein the first end 41 of the horizontal support 40 is fixedly attached to a position adjacent the upper end 22 of the outer member 21 of the first vertical support 20 and the second end 42 of the horizontal support 40 is fixedly attached to a position adjacent the upper end 32 of the outer member 31 of the second vertical support 30.

As shown in FIG. 2, the horizontal support 40 will generally include a collar member 44 extending around its central portion. The collar member 44 will preferably be positioned at the midpoint of the length of the horizontal support 40. As shown in FIG. 1, the collar member 44 will generally include a bracket 45 extending downwardly therefrom. The clamp assembly 50 of the present invention will generally be attached to the bracket 45 of the horizontal support 40 through use of a fastener 59 such as a bolt.

D. Clamp Assembly

As shown in FIG. 2, the present invention will generally include a clamp assembly 50, which is utilized to grasp, align and lift railroad tracks 12 when the present invention is in use. The clamp assembly 50 will generally include a first clamp member 51 and a second clamp member 52 and will be adjustable between an open position and a closed position through use of a pair of adjustment members 54, 58.

Figure 4:
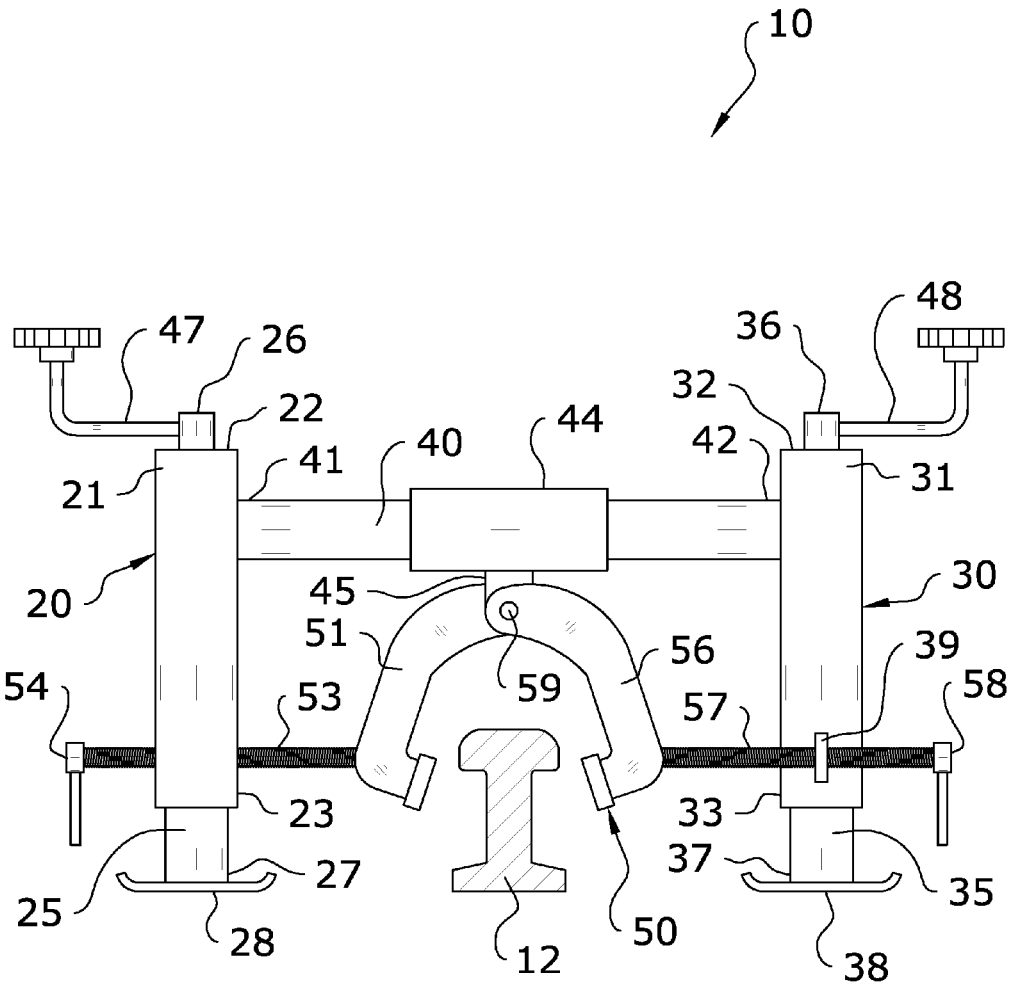
FIG. 4 is a first front view of the present invention in use.
Figure 5:
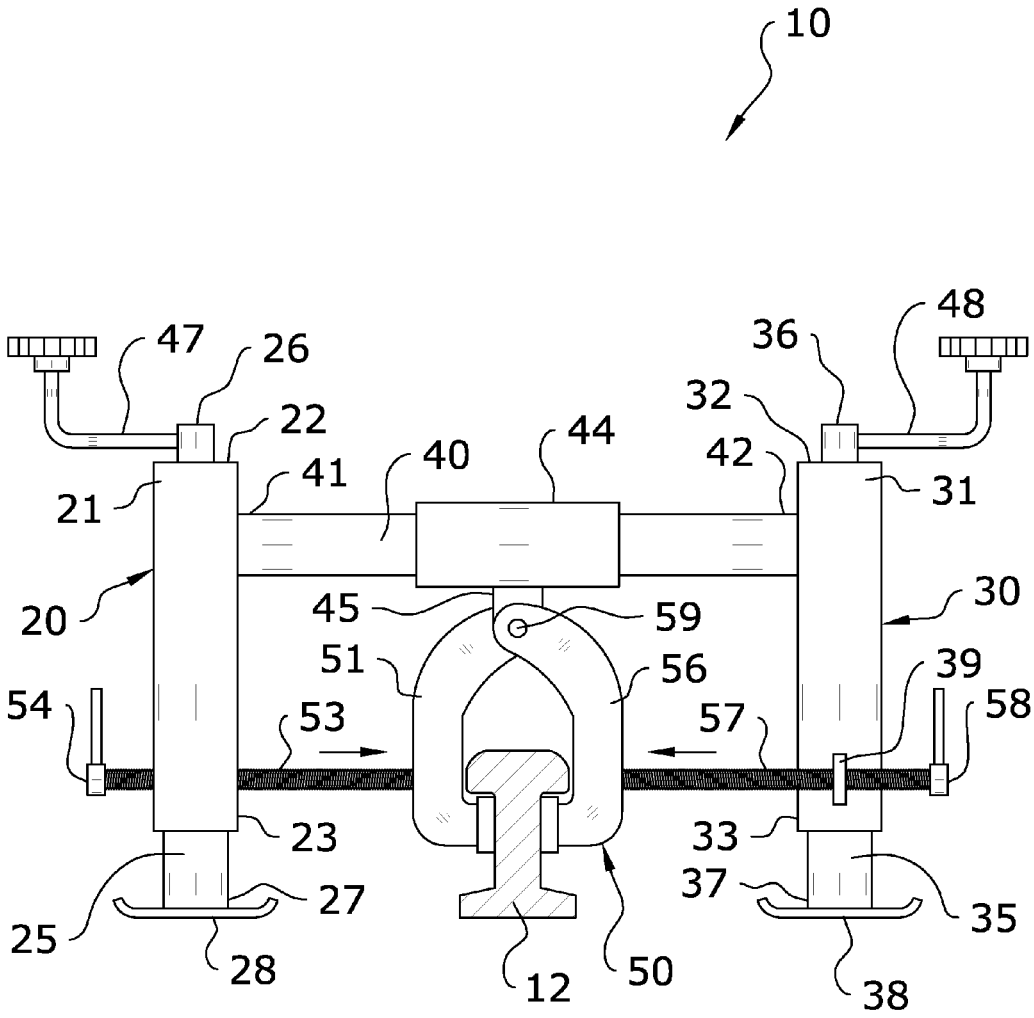
FIG. 5 is a second front view of the present invention in use.

The first and second clamp members 51, 56 will generally be linked together at their respective upper ends by a fastener 59 such as a bolt. The fastener 59 will preferably link the clamp members 51, 56 together in a manner which allows the clamp members 51, 56 to adjust toward each other to clamp structures and away from each other to release clamped structures as shown in FIGS. 4 and 5.

The first clamp member 51 of the present invention will generally include a first rod 53 extending therefrom in a direction away from the second clamp member 56 as shown in FIG. 1. The first rod 53 will preferably threadably extend through the bracket 29 of the outer member 21 of the first vertical support 20.

In a preferred embodiment, the first rod 53 will be threaded for its entire length and include an adjustment member 54 attached thereto. The adjustment member 54 may be utilized to rotate the first rod 53 within the bracket 29. Generally, rotation of the adjustment member 54 in a first direction will cause the first clamp member 51 to open and rotation of the adjustment member 54 in a second direction will cause the first clamp member 51 to close as shown in FIGS. 4 and 5.

The second clamp member 56 of the present invention will generally include a second rod 57 extending therefrom in a direction away from the first clamp member 51 as shown in FIG. 1. The second rod 57 will preferably threadably extend through the bracket 39 of the outer member 31 of the second vertical support 30.

In a preferred embodiment, the second rod 57 will be threaded for its entire length and include an adjustment member 58 attached thereto. The adjustment member 58 may be utilized to rotate the second rod 57 within the bracket 39. Generally, rotation of the adjustment member 58 in a first direction will cause the second clamp member 56 (and thus the clamp assembly 50) to open and rotation of the adjustment member 58 in a second direction will cause the second clamp member 56 to close as shown in FIGS. 4 and 5.

E. Operation of Preferred Embodiment

In use, the first vertical support 20 of the present invention is positioned on a first side of a track 12 and the second vertical support 30 is positioned on a second side of a track 12 with the clamp assembly 50 in an open position as shown in FIG. 4. The adjustment members 47, 48 may then be rotated in a first direction to close the clamp assembly 50 over the track 12 as shown in FIG. 5. By rotating the adjustment members 54, 58 of the clamp assembly 50, the track 12 may be lifted.

Additionally, a second railroad adjustment system 10 may be positioned on a second track 12 to assist with alignment as shown in FIG. 3. When completed, the adjustment members 47, 48 may be rotated in a second direction to open the clamp assembly 50 and remove the present invention for further use.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A railroad alignment system, comprising:

a first adjustable vertical support, wherein said first adjustable vertical support includes a foot member;

a second adjustable vertical support, wherein said second adjustable vertical support includes a foot member;

a horizontal support extending between said first vertical support and said second vertical support;

a collar extending around said horizontal support;

a bracket extending from said collar;

a clamp assembly secured to said bracket for securing, aligning and releasing a track, wherein said clamp assembly includes a first movable clamp member and a second movable clamp member;

a first rod attaching said first clamp member to said first vertical support, wherein said first rod includes a first adjustment member, wherein said first adjustment member is rotatable to open and close said first movable clamp member and wherein said second adjustment member is rotatable to open and close said second movable clamp member; and a second rod attaching said second clamp member to said second vertical support, wherein said second rod includes a second adjustment member.

2. The railroad alignment system of claim 1, wherein said first rod and said second rod are each threaded.

* * * * *